US005458395A

United States Patent [19]

Skarda, Jr.

[11] Patent Number: 5,458,395

[45] Date of Patent: Oct. 17, 1995

[54] STORAGE BOX IN THE SHAPE OF A BENCH

[76] Inventor: James F. Skarda, Jr., Balto, Md.

[21] Appl. No.: 218,436

[22] Filed: Mar. 28, 1994

[51] Int. Cl.[6] ..... A47C 7/62

[52] U.S. Cl. ..... 297/188.1; 297/188.04; 297/188.13; 297/173

[58] Field of Search ..... 297/173, 184.16, 297/193, 192, 188, 217, 331, 313, 344.1, 118, 129, 452.46, 452.42, 118.01, 188.08, 188.09, 188.1, 188.13, 188.04, 217.1; 206/372, 373; 220/334, 335; 108/25, 115, 152, 69; 312/279, 235.5

[56] References Cited

U.S. PATENT DOCUMENTS

| | | | |
|---|---|---|---|
| 2,381,667 | 8/1945 | Jensen et al. | 312/279 X |
| 2,658,640 | 11/1953 | Bayles | 297/193 X |
| 3,545,809 | 12/1970 | Krenz | 297/192 X |
| 3,972,560 | 8/1976 | White | 297/217 X |
| 4,474,407 | 10/1984 | Nazar | 297/192 |
| 4,717,202 | 1/1988 | Batchelder, III et al. | 297/193 X |
| 4,722,567 | 2/1988 | Hashihara | 297/217 |
| 4,789,200 | 12/1988 | Munguia | 297/184.16 |
| 5,035,464 | 7/1991 | Spallholtz | 297/192 X |
| 5,100,198 | 3/1992 | Baltzell | 297/192 |
| 5,269,157 | 12/1993 | Ciminelli et al. | 297/217 X |

FOREIGN PATENT DOCUMENTS

| | | | |
|---|---|---|---|
| 2520213 | 7/1983 | France | 297/188.11 |
| 3325048 | 1/1985 | Germany | 297/188.11 |
| 0406902 | 3/1934 | United Kingdom | 297/173 |

*Primary Examiner*—Kenneth J. Dorner
*Assistant Examiner*—Milton Nelson, Jr.

[57] ABSTRACT

A storage box in the shape of a bench comprising a lower frame structure in a generally box-like configuration having a lower horizontal base, an upwardly extending front wall, an upwardly extending back wall parallel with the front wall and extending to a higher elevation than the front wall, a pair of side panels extending upwardly from the base to a height at the front essentially co-extensive with the front wall and extending upwardly at the rear to an elevation essentially equal to that of the back wall with a generally L-shaped upper edge between the upper front edge and the upper rear edge; a lid having a horizontal upper surface positionable adjacent to the rearward upper edge of the back wall and the rearward extent of the side walls, a horizontal lower surface positionable adjacent to the forward upper edges of the side panels and with its forward edge located above the upper edge of the front wall and with a vertical panel coupling the upper and lower horizontal surfaces; and a hinge coupling the upper rear edge of the back wall with the rearward edge of the upper horizontal surface to allow the pivotal movement of the lid from a closed position sealing the frame structure and an open raised position allowing access to the interior of the frame structure.

6 Claims, 3 Drawing Sheets

FIG. 1
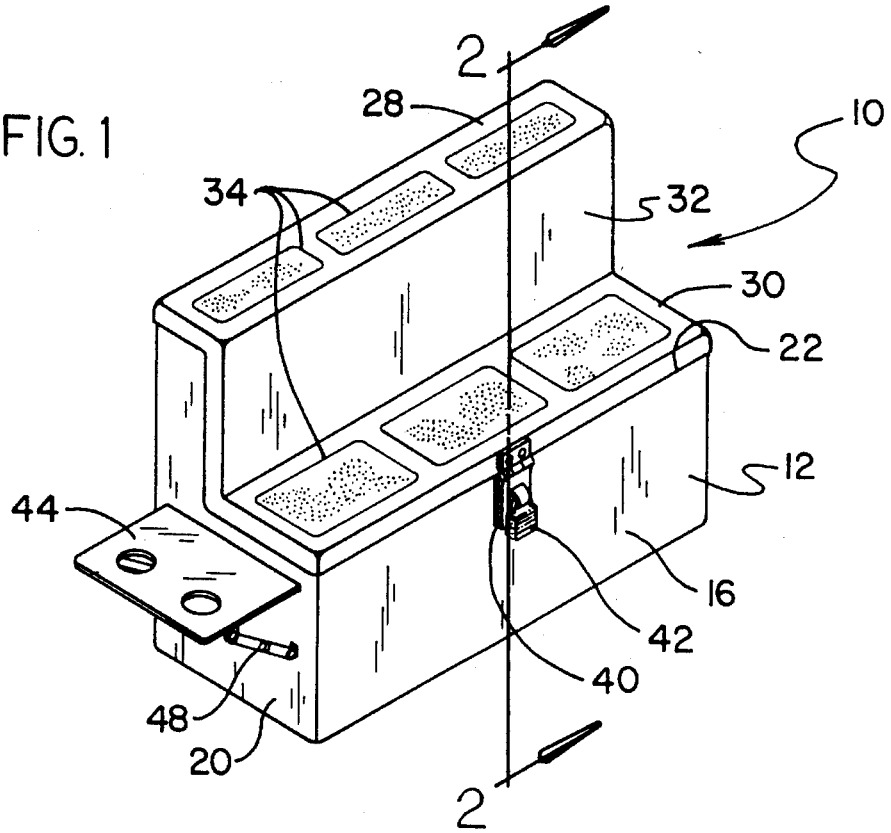
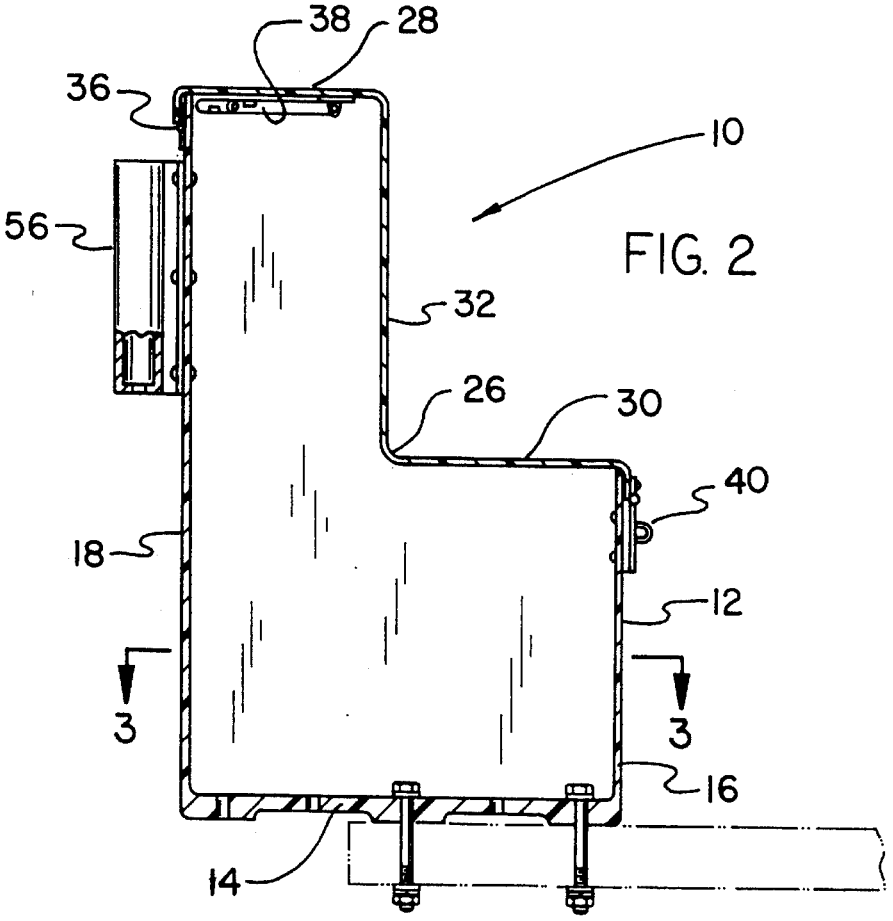
FIG. 2

STORAGE BOX IN THE SHAPE OF A BENCH

BACKGROUND OF THE INVENTION

1. Field of the Invention

The present invention relates to a storage box in the shape of a bench and more particularly pertains to storing objects in a box configured to function as a bench.

2. Description of the Prior Art

The use of storage containers and chairs is known in the prior art. More specifically, storage containers and chairs heretofore devised and utilized for the purpose of storing objects in containers shaped as a chair are known to consist basically of familiar, expected, and obvious structural configurations, notwithstanding the myriad of designs encompassed by the crowded prior art which has been developed for the fulfillment of countless objectives and requirements.

By way of example, U.S. Pat. No. Des. 330,329 to Brightbill discloses the design of a storage container.

U.S. Pat. No. Des. 329,747 to Embree discloses the design of a storage locker.

U.S. Pat. No. Des. 309,106 to Willson discloses the design of a dock storage box.

U.S. Pat. No. Des. 251,153 to Thompson discloses the design of a marine dock storage locker.

U.S. Pat. No. 3,987,829 to Leone discloses a container with lid.

In this respect, the storage box in the shape of a bench according to the present invention substantially departs from the conventional concepts and designs of the prior art, and in doing so provides an apparatus primarily developed for the purpose of storing objects in a box configured to function as a bench.

Therefore, it can be appreciated that there exists a continuing need for new and improved storage boxes in the shape of a bench which can be used for storing objects in a box configured to function as a bench. In this regard, the present invention substantially fulfills this need.

SUMMARY OF THE INVENTION

In view of the foregoing disadvantages inherent in the known types of storage containers and chairs now present in the prior art, the present invention provides an improved storage box in the shape of a bench. As such, the general purpose of the present invention, which will be described subsequently in greater detail, is to provide a new and improved storage box in the shape of a bench and which has all the advantages of the prior art and none of the disadvantages.

To attain this, the present invention essentially comprises a new and improved storage box in the shape of a bench comprising, in combination, a lower frame structure in a generally box-like configuration having a lower horizontal base, an upwardly extending front wall, an upwardly extending back wall parallel with the front wall and extending to a higher elevation than the front wall, a pair of side panels extending upwardly from the base to a height at the front essentially co-extensive with the front wall and extending upwardly at the rear to an elevation essentially equal to that of the back wall with a generally L-shaped upper edge between the upper front edge and the upper rear edge; a lid having a horizontal upper surface positionable adjacent to the rearward upper edge of the back wall and the rearward extent of the side walls, a horizontal lower surface positionable adjacent to the forward upper edges of the side panels and with its forward edge located above the upper edge of the front wall and with a vertical panel coupling the upper and lower horizontal surfaces; a hinge coupling the upper rear edge of the back wall with the rearward edge of the upper horizontal surface to allow the pivotal movement of the lid from a closed position sealing the frame structures and an open raised position allowing access to the interior of the frame structure; locking components coupled between the forward edge of the lower horizontal component and the upper edge of the front wall; a drop-leaf table pivotally secured to at least one side wall with pivotal rods adapted to secure the table in a horizontal orientation and to allow the dropping thereof to a generally vertical inoperative orientation; bolt holes extending through the base plate for coupling the device to a recipient surface such as a dock with a plurality of drain holes formed in the bottom wall; and an umbrella holder secured to the exterior surface of the back wall.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide new and improved storage boxes in the shape of a bench which have all the advantages of the prior art storage containers and chairs and none of the disadvantages.

It is another object of the present invention to provide new and improved storage boxes in the shape of a bench which may be easily and efficiently manufactured and marketed.

It is further object of the present invention to provide new and improved storage boxes in the shape of a bench which are of durable and reliable construction.

An even further object of the present invention is to provide new and improved storage boxes in the shape of a bench which are susceptible of a low cost of manufacture with regard to both materials and labor, and which accordingly are then susceptible of low prices of sale to the consuming public, thereby making such storage boxes in the shape of a bench economically available to the buying public.

Still yet another object of the present invention is to provide new and improved storage boxes in the shape of a bench which provide in the apparatuses and methods of the prior art some of the advantages thereof, while simultaneously overcoming some of the disadvantages normally associated therewith.

Still another object of the present invention is to store objects in a box configured to function as a bench.

Lastly, it is an object of the present invention to provide a new and improved storage box in the shape of a bench comprising a lower frame structure in a generally box-like configuration having a lower horizontal base, an upwardly extending front wall, an upwardly extending back wall parallel with the front wall and extending to a higher elevation than the front wall, a pair of side panels extending upwardly from the base to a height at the front essentially co-extensive with the front wall and extending upwardly at the rear to an elevation essentially equal to that of the back wall with a generally L-shaped upper edge between the upper front edge and the upper rear edge; a lid having a horizontal upper surface positionable adjacent to the rearward upper edge of the back wall and the rearward extent of the side walls, a horizontal lower surface positionable adjacent to the forward upper edges of the side panels and with its forward edge located above the upper edge of the front wall and with a vertical panel coupling the upper and lower horizontal surfaces; and a hinge coupling the upper rear edge of the back wall with the rearward edge of the upper horizontal surface to allow the pivotal movement of the lid from a closed position sealing the frame structure and an open raised position allowing access to the interior of the frame structure.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective illustration of the preferred embodiment of the new and improved storage box in the shape of a bench constructed in accordance with the principles of the present invention.

FIG. 2 is a cross sectional view of the device illustrated in FIG. 1 taken along a vertical line through the center of the device.

The same reference numerals refer to the same parts through the various Figures.

DESCRIPTION OF THE PREFERRED EMBODIMENT

Figure 3:
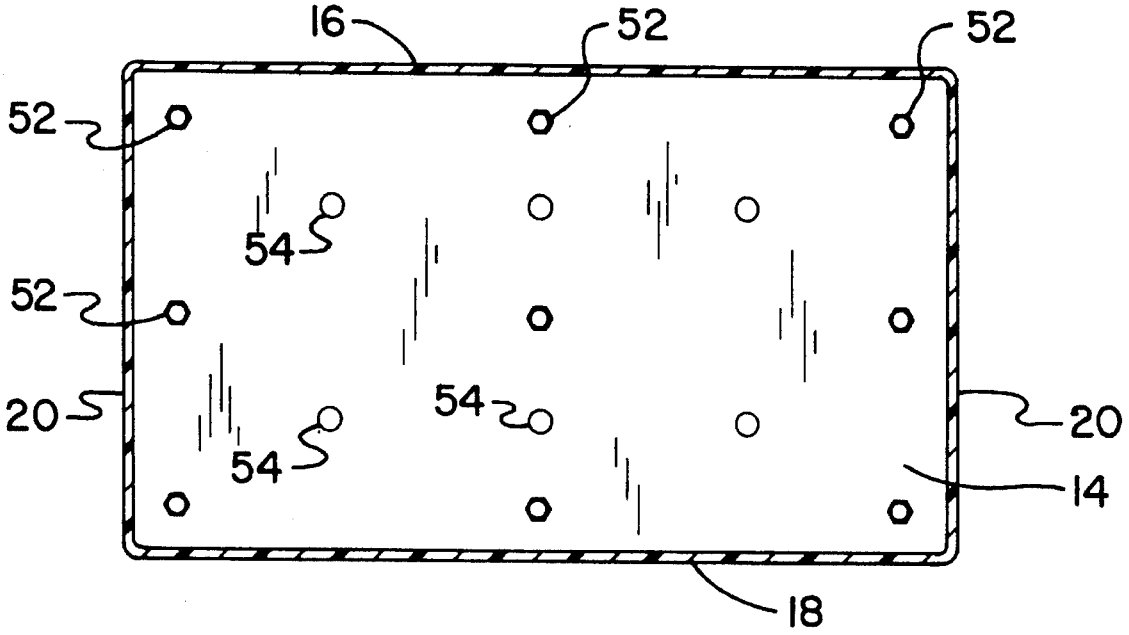
FIG. 3 is a bottom view of the device illustrated in FIGS. 1 and 2.
Figure 4:
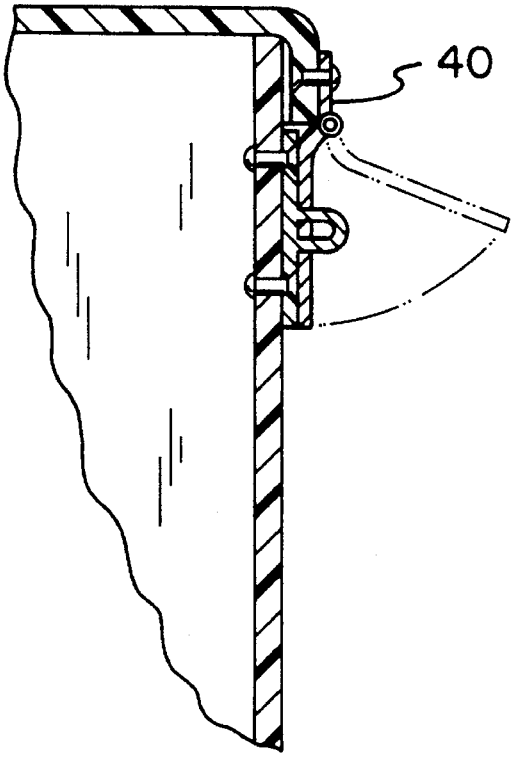
FIG. 4 is an enlarged sectional view of the portion of the device of the prior Figures taken at the locking components.

With reference now to the drawings, and in particular to FIG. 1 thereof, the preferred embodiment of the new and improved storage box in the shape of a bench embodying the principles and concepts of the present invention and generally designated by the reference numeral 10 will be described.

The present invention, the new and improved storage box in the shape of a bench, is comprised of a plurality of components. The components are specifically configured and correlated with respect to each other to attain the desired objectives. In their broadest context, such components include a lower frame structure, a lid, a hinge, locking components, a drop-leaf table, bolt holes and drain holes and an umbrella holder.

More specifically, the lower frame structure 12 is a generally box-like member configured to have a lower horizontal base 14. Upstanding therefrom is a front wall 16, an upwardly extending back wall 18 which are parallel along with parallel side walls 20. The back wall extends upwardly to a higher elevation than the front wall. The side walls extend upwardly to a height at the front essentially co-extensive with the front wall. The side walls extend upwardly at the rear to an elevation essentially equal to that of the back wall. In addition, the lower frame structure has an L-shaped upper edge 22 between the upper front edge and the upper rear edge.

The lid 26 is the second major component of the system. It has a horizontal upper surface 28 which is positionable adjacent to the rearward upper edge of the back wall and the rearward extent of the side wall. The lid also has a horizontal lower surface 30. The lower surface is positionable adjacent to the forward upper edges of the side panels with its forward edge located above the upper edge of the front wall. The lid also has a vertical panel 32 coupling the upper and lower horizontal surfaces. Rectangular panels 34 of non-slip material are provided on the horizontal surfaces.

Figure 5:
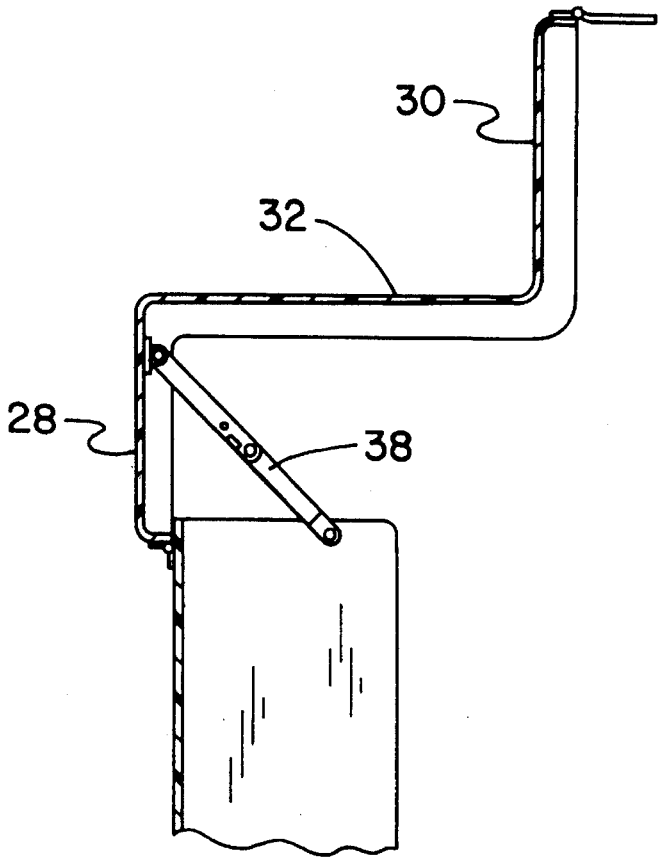
FIG. 5 is an enlarged sectional view illustrating the opening and closing of the device.

Coupling between the lid and the frame structure is a hinge 36. The hinge couples the rear edge of the back wall with the rearward edge of the horizontal upper surface. This allows for pivotal movement of the lid from a closed position, FIGS. 1 & 2, sealing the frame structure and an opened raised position, FIG. 5, allowing access to the interior of the frame structure. A pivotable coupling 38 extends to hold the lid in the open orientation. Also coupled between the lid and the frame structure are locking components 40. The locking components are coupled between the forward edge of the lower horizontal component and the upper edge of the front wall. The locking components function in association with a padlock 42, to secure the lid in its lower orientation to protect sealed components within the frame structure.

Figure 6:
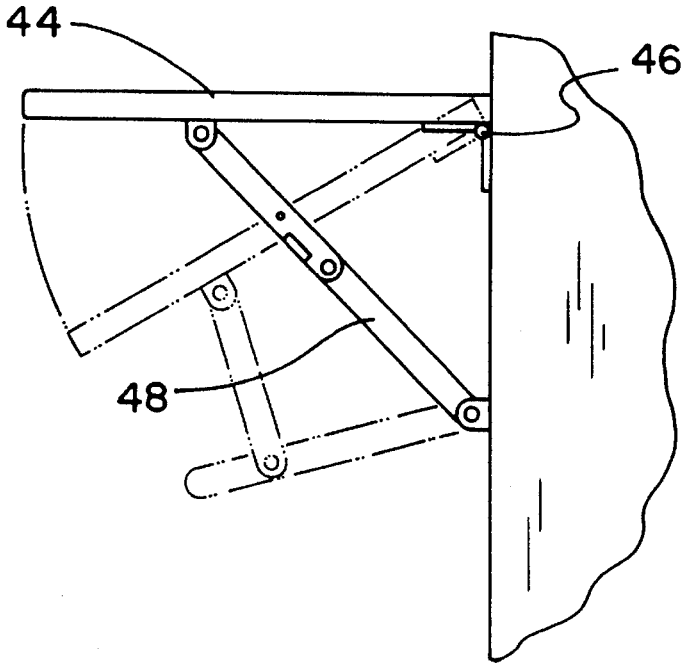
FIG. 6 is an enlarged end view of the drop-leaf drink table on at least one side of the device.

As shown in FIGS. 1 and 6, there is preferably provided a drop-leaf table 44. The drop-leaf table is pivotally secured to at least one side wall of the frame structure. It includes a hinge 46 and pivot rods 48 adapted to secure the table in a horizontal orientation during operation and use. Note the solid line configurations of FIGS. 1 and 6. The pivot rods are also pivotable at the central extent thereof to allow the dropping of the table through a generally inoperative orientation when not in use.

Holes are provided in the base plate. Such holes include bolt holes 52 extending through the base plate for coupling the entire device to a recipient surface. A preferred recipient surface is a dock. In addition, a plurality of drain holes 54 are formed in the bottom wall. The drain holes allow for the flowing from the device of water resulting when ice therein melts.

Lastly, there is provided an umbrella holder 56. The umbrella holder has a closed bottom wall and side walls and an open top adapted to receive umbrellas or other components of a linear nature which might be used in association with the device.

The present invention is a multi-purpose storage and seating device. It is a dry secure storage facility for any outside use including docks at boat moorings. It can also be used for steps to get onto a boat replacing the need for dock steps. It serves as a seating area together with an umbrella holder plus small side tables. The present invention could also be used as the point of service for utilities at marinas. Due to its design it can cantilever past the edge of a pier allowing for as little use of pier space as possible.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved storage box in the shape of a bench comprising in combination:

a lower frame structure in a generally box-like configuration, the lower frame structure having a lower horizontal base with a number of drain holes formed therein, an upwardly extending front wall having an upper edge, an upwardly extending back wall having an upper edge and an exterior surface, the back wall being parallel with the front wall and extending to a higher elevation than the front wall, a pair of side panels extending upwardly from the lower horizontal base, each of the side panels having a forward portion with an upper edge and a rearward portion with an upper edge, the forward portion of each of the side panels being essentially co-extensive with the front wall and the rearward portion of each of the side panels being essentially co-extensive with the back wall;

a lid having a horizontal upper surface positionable adjacent to the upper edge of the back wall and the upper edge of the rearward portion of each of the side panels, a horizontal lower surface positionable adjacent to the upper edge of the front wall and the upper edge of the forward portion of each of the side panels, a vertical panel coupling the horizontal upper surface and the horizontal lower surface;

a hinge coupling the upper edge of the back wall with the horizontal upper surface to allow pivotal movement of the lid from a closed position sealing the lower frame structure and an open raised position allowing access to the interior of the lower frame structure;

locking components coupled between the horizontal lower surface and the upper edge of the front wall;

a drop-leaf table pivotally secured to one of the side panels with pivotal rods adapted to secure the table in a horizontal orientation and to allow the dropping thereof to a generally vertical inoperative orientation;

bolt holes extending through the horizontal base for coupling the storage box to a recipient surface such as a dock;

an umbrella holder secured to the exterior surface of the back wall.

2. A new and improved storage box in the shape of a bench comprising in combination:

a lower frame structure in a generally box-like configuration, the lower frame structure having a lower horizontal base with a number of drain holes formed therein, an upwardly extending front wall having an upper edge, an upwardly extending back wall having an upper edge and an exterior surface, the back wall being parallel with the front wall and extending to a higher elevation than the front wall, a pair of side panels extending upwardly from the lower horizontal base, each of the side panels having a forward portion with an upper edge and a rearward portion with an upper edge, the forward portion of each of the side panels being essentially co-extensive with the front wall and the rearward portion of each of the side panels being essentially co-extensive with the back wall;

a lid having a horizontal upper surface positionable adjacent to the upper edge of the back wall and the upper edge of the rearward portion of each of the side panels, a horizontal lower surface positionable adjacent to the upper edge of the front wall and the upper edge of the forward portion of each of the side panels, a vertical panel coupling the horizontal upper surface and the horizontal lower surface;

a hinge coupling the upper edge of the back wall with the horizontal upper surface to allow pivotal movement of the lid from a closed position sealing the lower frame structure and an open raised position allowing access to the interior of the lower frame structure.

3. The storage box as set forth in claim 2 and further including:

locking components coupled between the horizontal lower surface and the upper edge of the front wall.

4. The storage box as set forth in claim 2 and further including:

a drop-leaf table pivotally secured to one of the side panels with pivotal rods adapted to secure the table in a horizontal orientation and to allow the dropping thereof to a generally vertical inoperative orientation.

5. The storage box as set forth in claim 2 and further including:

bolt holes extending through the horizontal base for coupling the storage box to a recipient surface such as a dock;

6. The storage box as set forth in claim 2 and further including:

an umbrella holder secured to the exterior surface of the back wall.

* * * * *